US005472195A

United States Patent [19]

Takemoto et al.

[11] Patent Number: 5,472,195

[45] Date of Patent: Dec. 5, 1995

[54] DISPLAY SYSTEM AT A GAME MACHINE ISLAND

[75] Inventors: Takatoshi Takemoto; Masayuki Tsurumi, both of Tokyo, Japan

[73] Assignee: Kabushiki Kaisha Ace Denken, Tokyo, Japan

[21] Appl. No.: 256,114

[22] PCT Filed: Dec. 25, 1992

[86] PCT No.: PCT/JP92/01705

§ 371 Date: Jun. 23, 1994

§ 102(e) Date: Jun. 23, 1994

[87] PCT Pub. No.: WO93/12849

PCT Pub. Date: Aug. 7, 1992

[30] Foreign Application Priority Data

| | | | |
|---|---|---|---|
| Dec. 25, 1991 | [JP] | Japan | 3-343696 |
| Feb. 21, 1992 | [JP] | Japan | 4-035340 |

[51] Int. Cl.[6] ..... G07F 17/34

[52] U.S. Cl. ..... 273/138 A; 273/143 R

[58] Field of Search ..... 273/138 A, 143 R, 273/138 R, 139

[56] References Cited

FOREIGN PATENT DOCUMENTS

| | | | |
|---|---|---|---|
| 202084 | 9/1991 | Japan . | |
| 17876 | 1/1992 | Japan . | |
| 37486 | 3/1992 | Japan . | |
| 90779 | 3/1992 | Japan . | |
| 2062922 | 5/1981 | United Kingdom | 273/143 R |
| 2097160 | 10/1982 | United Kingdom | 273/138 A |
| 2157047 | 10/1985 | United Kingdom | 273/143 R |
| 2192478 | 1/1988 | United Kingdom | 273/138 A |

*Primary Examiner*—Benjamin H. Layno

*Attorney, Agent, or Firm*—Andrus, Sceales, Starke & Sawall

[57] ABSTRACT

A system for displaying occurrence of an event at a game machine island (10) having at least one game machine row comprising a plurality of game machines (1) placed side by side. The display system comprises a dome display (200) having a display area provided along the game machine row of the game machine island (10) for displaying in the display area and a display controller (300) for controlling the operation of the dome display. A plurality of display units are distributed into those positioned to the left, when viewed facing the game machine row, and those positioned to the right, with the position corresponding to the position of a game machine when an event occurs as reference. The display units positioned to the left are made to display in a display mode representing directionality from the left end to the reference position and the display units positioned to the right are made to display in a display mode representing directionality from the right end to the reference position.

13 Claims, 7 Drawing Sheets

DISPLAY SYSTEM AT A GAME MACHINE ISLAND

TECHNICAL FIELD

This invention relates to a display system for making an effective appeal with respect to a game machine where trouble or the like occurs or in the event of a winning condition of a game machine where a player wins game plays at a game machine island (dome) having a plurality of game machines such as slot machines.

TECHNICAL BACKGROUND

In a game house having a number of game machines such as slot machines, problems may occur at the machines, or a player may perform an illegal or cheating act. If a player meets a given condition while playing at a game machine, game play media such as medals are paid out to the player for the winning game plays from the game machine. If the player wins game plays repeatedly at the game machine, the game machine may be locked onto a win, namely, placed in a closed condition. In such a case, the player needs to call personnel in the game house so that they can take appropriate action.

When the need to call personnel occurred, hitherto, the player pressed a call switch, or the game machine automatically caused a call lamp or buzzer installed on the game machine to blink or beep to inform only personnel near to the game machine unit.

Thus, the related art was not satisfactory to give personnel in the game house immediate and obvious information about the game machine where problems or the like occurred. This is because it is next to impossible for personnel to observe a large number of game machines at any one time or because personnel do not always exist at a position near the game machine to such a degree that they can recognize the produced indication or alarm for the game machine promptly.

In a game house, when a player wins a game play at a game machine such as a slot machine, the game machine uses display means installed on the game machine to make representation such as displaying graphics representing the winning game play, blinking flash lamps, and producing sound through a loudspeaker celebrating the winning game play, applauding the player, and congratulating the player on his or her luck.

In such a case, the successful player would want to feel a sense of his or her own superiority over other players. On the other hand, unsuccessful players raise the sense of expectation of their own success from the success of another person. The players in such a mental state will be intent on playing games; this effect is favorable to game house managers for effective use of game machines.

However, the conventional appeal for winning game plays has been made only at the game machine. Thus, it is difficult for other players to know at which game machine a player has won games. As a result, the successful player does not really have the sense of superiority over other players. It is also unsatisfactory as unsuccessful players do not increase their sense of expectation of winning game plays, and thus the enjoyment of the game is not increased the pleasure of games.

DISCLOSURE OF INVENTION

It is therefore an object of the invention to provide a display system which can make an appeal which reaches over a wide range of a game house for indicating the occurrence of an event such as a problem at any game machine.

To this end, according to a first form of the invention, there is provided a system for displaying the occurrence of an event at a game machine island having at least one game machine row comprising a plurality of game machines placed side by side, the display system comprising:

a dome display having a display area, provided along the game machine row of the game machine island for displaying in the display area; and a display controller for controlling the operation of the dome display, the dome display comprising a plurality of display units for displaying in a specified mode and drive circuits for driving the display units, the display units being disposed in the display area, the display controller comprising:

event occurrence information read means, when a signal indicating that any game machine in the game machine row is in a predetermined specific condition is input, for reading information indicating the physical location of the game machine;

means for distributing the display units into those being positioned to the left, when facing the game machine row and those positioned to the right, with the position corresponding to the position indicated by the information as reference; and means for controlling so as to cause the display units positioned to the left to display in a display mode representing directionality from the left end to the reference position and to cause the display units positioned to the right to display in a display mode representing directionality from the right end to the reference position.

Each of the display units can have at least one light emitting element, and the control means can change the light and shade of the light emitting elements of the display units in the order in which the display units are arranged so as to create a display mode representing the directionality.

Each of the display units can have a plurality of light emitting elements arranged along the game machine row, and the control means can change the light and shade of the light emitting elements in the order in which they are arranged in each display unit so that a display mode representing directionality is created.

The event occurrence information read means can further include a function of reading information indicating contents of a specific condition occurring at any game machine. The display controller means can further comprise means for storing information for specifying a predetermined display mode in response to the information indicating the specific condition contents. The control means can read the stored information for specifying a display mode in response to the read information indicating the specific condition contents for causing the display means to display in the display mode.

The event occurrence information read means can have at least either of a function of reading information indicating occurrence of an event at any game machine and a function of reading information indicating that any game machine is placed in a winning condition.

Each of the display units can have a light emitting element and a graphics pattern display section for displaying a graphics pattern lit by the light emitting element.

The graphics pattern display section can have a graphics pattern showing directionality from left to right and a graphics pattern showing directionality from right to left and selectively lights either of them by the light emitting element in response to an instruction from the display controller means.

Each of the display units can have a panel display and each of the drive circuits can have a memory which stores image data for generating graphics displayed on the screen of the panel display.

The drive circuit can have means for moving image data in a direction conforming to the directionality on the screen of the panel display.

The memory stores image data representing graphics patterns corresponding to the two types of directionality.

According to another form of the invention, there is provided a system for displaying occurrence of an event at a game machine island having at least one game machine row comprising a plurality of game machines placed side by side, the display system comprising:

a display having a display area in each game machine for displaying in the display area; and a display controller for controlling the operation of the display, the display comprising a plurality of display units for displaying in a specified mode and drive circuits for driving the display units, the display units being disposed in the display area, the display controller comprising:

event occurrence information read means, when a signal indicating that any game machine in the game machine row is in a predetermined specific condition is input, for reading information indicating the position of the game machine;

means for distributing the display units into those positioned to the left, when facing the game machine row and those positioned to the right, with the position corresponding to the position indicated by the information as reference; and means for controlling so as to cause the display units positioned to the left to display in a display mode representing directionality from the left end to the reference position and to cause the display units positioned to the right to display in a display mode representing directionality from the right end to the reference position.

According to still another form of the invention, there is provided a system for displaying occurrence of an event at a game machine island having at least one game machine row comprising a plurality of game machines placed side by side, each game machine comprising a display within which an area for playing games is displayed, the display system comprising:

a display controller, upon occurrence of some event for any game machine in the game machine row, for controlling so as to change the display mode of the displays of the game machines belonging to the same game machine row accordingly, the display controller comprising:

event occurrence information read means for reading event occurrence information indicating occurrence of an event for any game machine in the game machine row;

means for distributing the game machines into those positioned to the left, when facing the game machine row, and those positioned to the right, with the position of the game machine indicated by the event occurrence information as reference; and control means for instructing the displays of the game machines positioned to the left to display in a display mode representing directionality from the left end to the reference position and the displays of the game machines positioned to the right to display in a display mode representing directionality from the right end to the reference position, each of the game machines having a storage, for storing image data for display in the game play display area and background image data for display in a peripheral area outside the game play display area and, display means for reading image data from the storage and displaying on the display, the display means for displaying a background image on the display in response to an instruction from the control means.

According to another form of the invention there is provided a system for displaying the occurrence of an event in a game machine island having at least one game machine row comprising a plurality of game machines placed side by side each game machine comprising a display, within which an area for playing games is displayed, the display system comprising:

a dome display having a display area provided along the game machine row of the game machine island for displaying in the display area; and a display controller, upon occurrence of some event for any game machine in the game machine row, for controlling so as to change the display modes of the displays of the game machines and the dome display belonging to the same game machine row accordingly, the dome display comprising a plurality of display units for displaying in a specified mode and drive circuits for driving the display units, the display units being disposed in the display area, the display controller comprising:

event occurrence information read means for reading event occurrence information indicating occurrence of an event for any game machine in the game machine row;

means for distributing the game machines and display units into those positioned to the left, when facing the game machine row, and those positioned to the right, with the position of the game machine indicated by the event occurrence information as reference; and control means for instructing the game machines and the display units positioned to the left to display in a display mode representing directionality from the left end to the reference position and those positioned to the right to display in a display mode representing directionality from the right end to the reference position, each of the game machines having a storage, for storing image data for display in the game play display area and background image data for display in a peripheral area outside the game play display area, and display means for reading image data from the storage and displaying on the display, the display means for displaying a background image on the display in response to an instruction from the control means.

According to the call and display system at the game machine island of the invention, if a personnel call source, such as a problem, occurs at a game machine in the game machine island, the display control means controls the display units disposed throughout the entire area in the longitudinal direction where the game machines are located so that graphics patterns or light and shade displayed on the display means are moved toward the game machine. Thus, if a problem or the like occurs at any game machine, an appeal is seen over a wide range of the entire game machine island, indicating the occurrence of a problem or the like at the game machine.

If the game machines use a liquid crystal display system and graphics patterns or light and shade displayed on the liquid crystal screen of each game machine except the game play graphics pattern display portion move toward the game machine in a winning condition, the liquid crystal screens display an appeal over a wide range of the entire game machine island to indicate the occurrence of a problem or the like at the game machine, and moreover display means dedicated to calling personnel in the game house need not be provided.

Further, if the color of graphics patterns or the like displayed on the display means or liquid crystal screen is varied depending on the type of call source, personnel in the game house can know more precisely the type of call source, for example, that it is a problem or an illegal act.

Thus, according to the display system at the game machine island according to the invention, if a personnel call source such as a problem occurs at any game machine, personnel in the game house can be informed immediately and precisely of the game machine where the incident has occurred.

Moreover, if the color of graphics patterns or the like displayed on the display means, etc., is varied depending on the type of call source, personnel in the game house can know precisely the type of call source, and can take appropriate action to deal with the problem, etc., promptly. Therefore, the display system of the invention can contribute to increased demand for game systems and development of the industry.

BEST MODE FOR CARRYING OUT THE INVENTION

Referring now to the accompanying drawings, there are shown embodiments of display systems of the invention.

Figure 4:
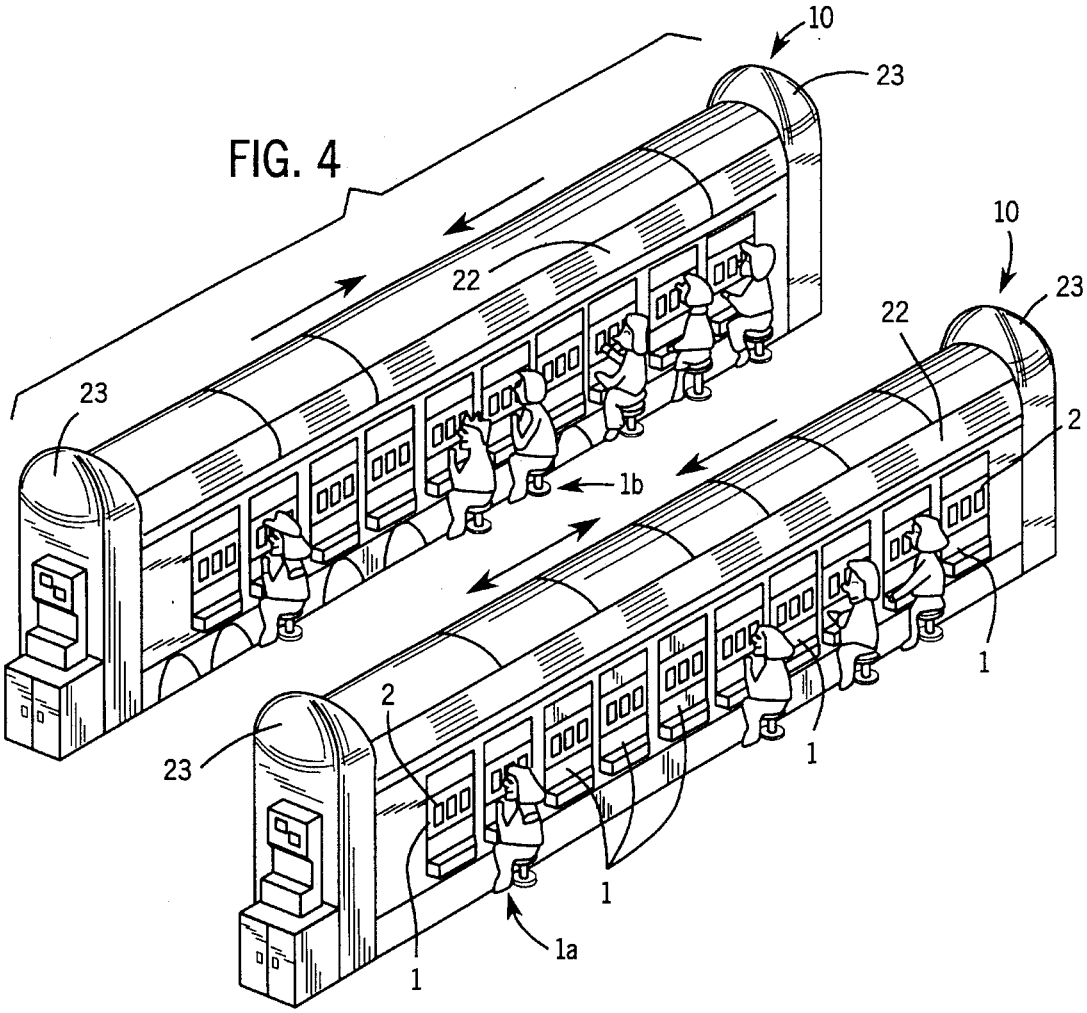
FIG. 4 is a perspective view showing a game machine island to which a call and display system in the embodiment of the invention is applied.

A display system according to one embodiment of the invention is applied to a game machine island 10 having at least one row of game machines 1 placed side by side each comprising a display 2 within which an area for playing games is displayed, as shown in FIG. 4. The system is for indicating the occurrence of events at the game machine island 10.

Figure 1:
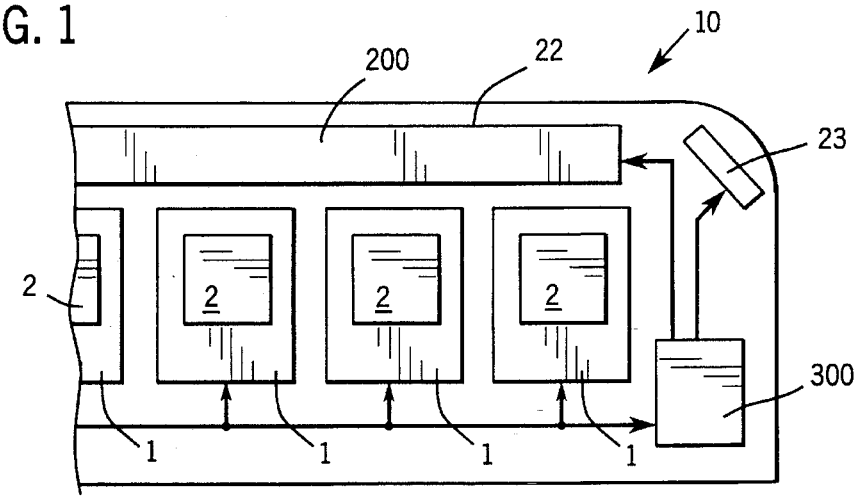
FIG. 1 is a block diagram showing the configuration of a game machine island to which a display system according to one embodiment of the invention is applied.
Figure 2:
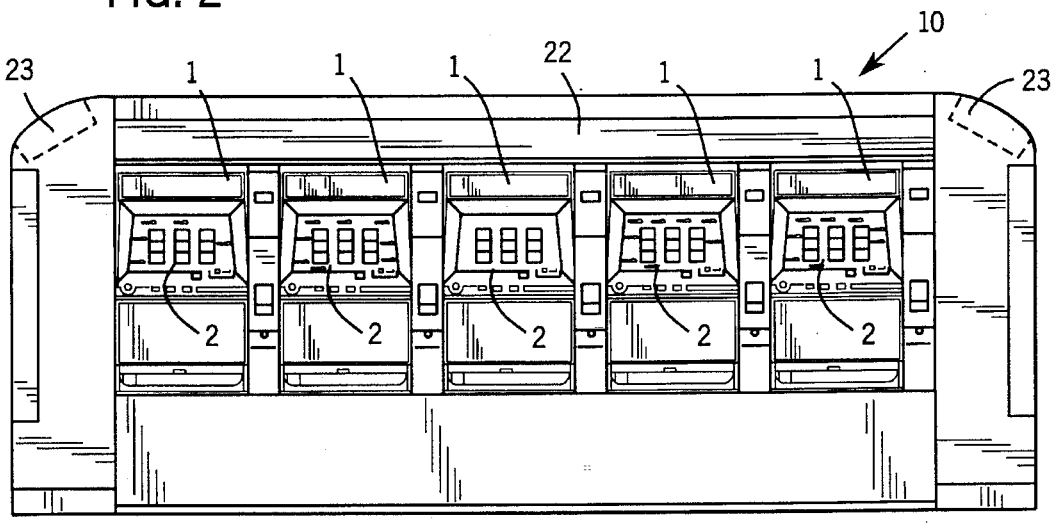
FIG. 2 is a front view showing the game machine island to which the display system according to the embodiment of the invention is applied.

The display system according to the embodiment comprises a dome display 200 for displaying in a specified mode in a display area 22 disposed along a game machine row on the top of a game machine island 10 and a display controller 300, when some event occurs for any game machine 1 in the game machine row, for controlling accordingly so as to change the display modes of the displays 2 of the game machines 1 and the dome display 200 belonging to the same game machine row, as shown in FIG. 1.

Figure 6:
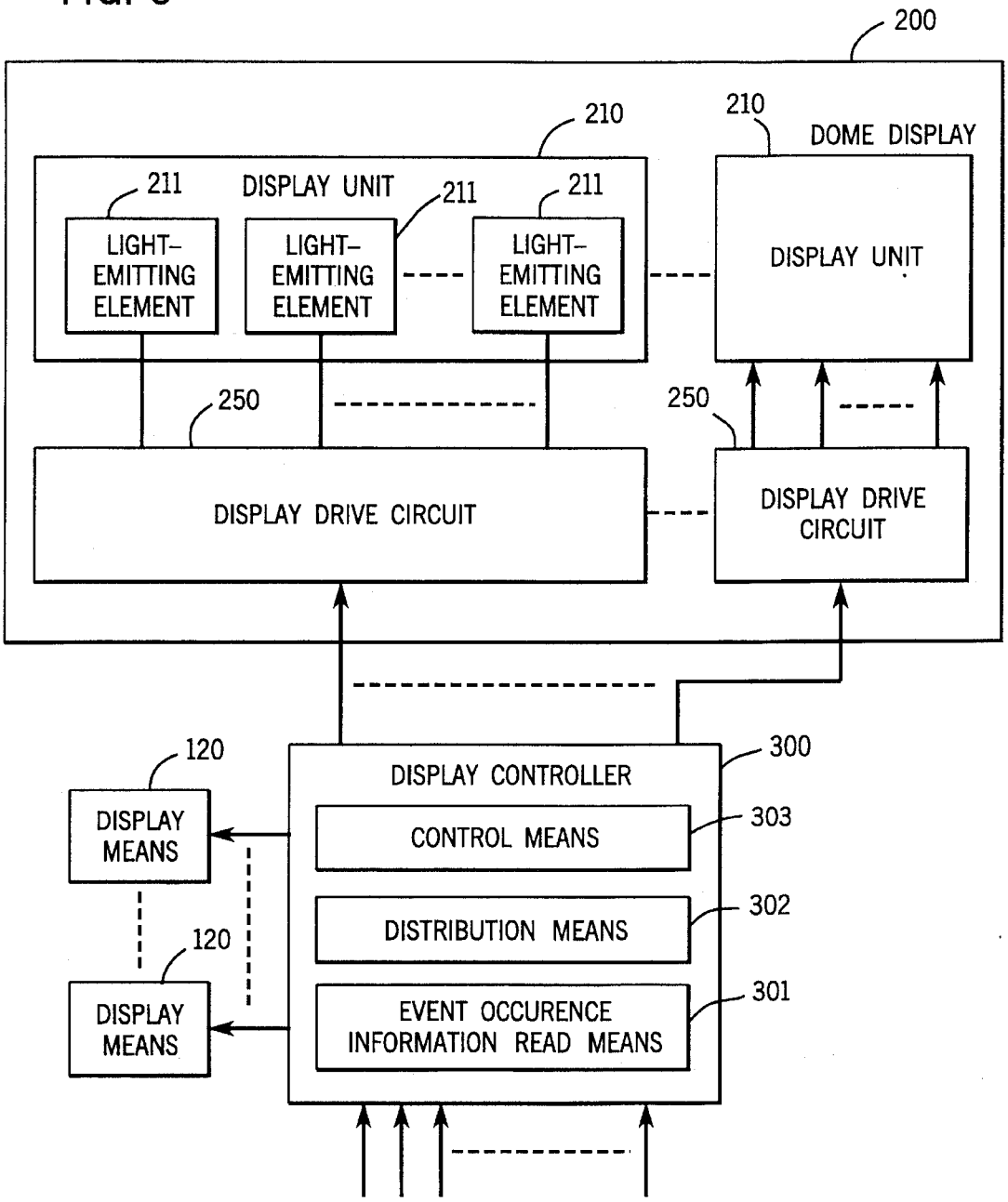
FIG. 6 is a block diagram showing the configuration of a dome display and a display controller used in the embodiment of the invention.

The dome display 200 has a plurality of display units 210 for displaying in the specified mode and a plurality of display drive circuits 250 for driving these display units 210, as shown in FIG. 6. The display units 210 are arranged in the display area 22 shown in FIG. 4 in the longitudinal direction of the game machine island 10, namely, along the game machine row. In the embodiment, they are provided in three colors of red, blue, and green.

They can be made to blink separately. More specifically, light emitting elements or color filters for emitting light of the colors are disposed, for example, as a striped structure. The colors are not limited to those mentioned. It is also possible to use only one color.

The display unit 250 has a plurality of light emitting elements 211 and a circuit 210 for driving the light emitting elements so as to produce light and shade. The size of the display unit 210 can be determined so as to conform to the width of the game machine, for example.

The light emitting elements can be made of fluorescent lamps, tungsten lamps, light emitting diodes, etc., for example.

The light emitting face form, the number, and arrangement of the light emitting elements 211 are determined so that a light band extending in the width direction of the display area 22 can be generated. The light emitting element 211 may be a set of light emitting substances.

In addition to colors produced from appropriate light emitting substances, color filters may be used.

Figure 5:
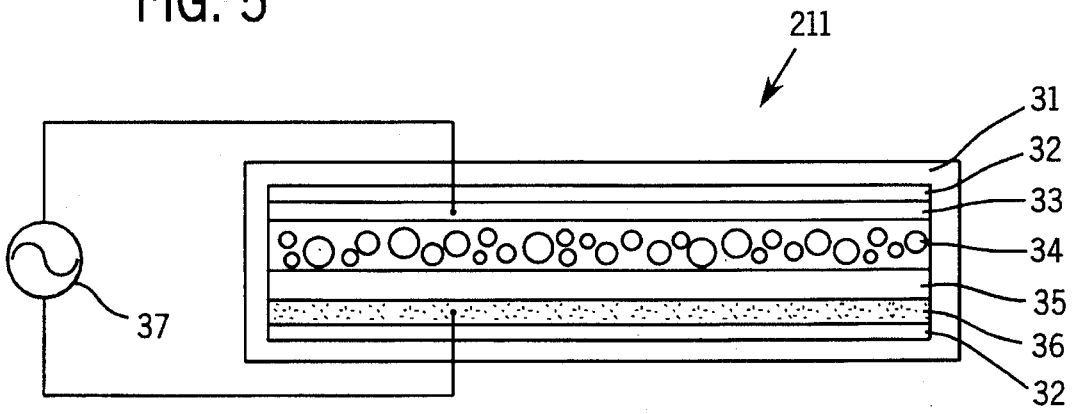
FIG. 5 is a sectional view showing a structure example of light emitting element in the embodiment of the invention.

The light emitting element 211 can also be made of an organic dispersion electro-luminescence lamp which comprises moisture absorption layers 32, a transparent electrode layer 33, a light emitting layer 34, an insulation layer 35, and a back plate layer 36 laminated on each other within a moisture proof film 31 forming a surface layer, as shown in FIG. 5. This type of element uses light emitted by applying an alternating electric field to phosphor contained in the light emitting layer 34. The light emitting element 211 has features of thin form, light weight, shock resistance, uniform face light emission, low power consumption, small heating value, and high flexibility in form.

Figure 7:
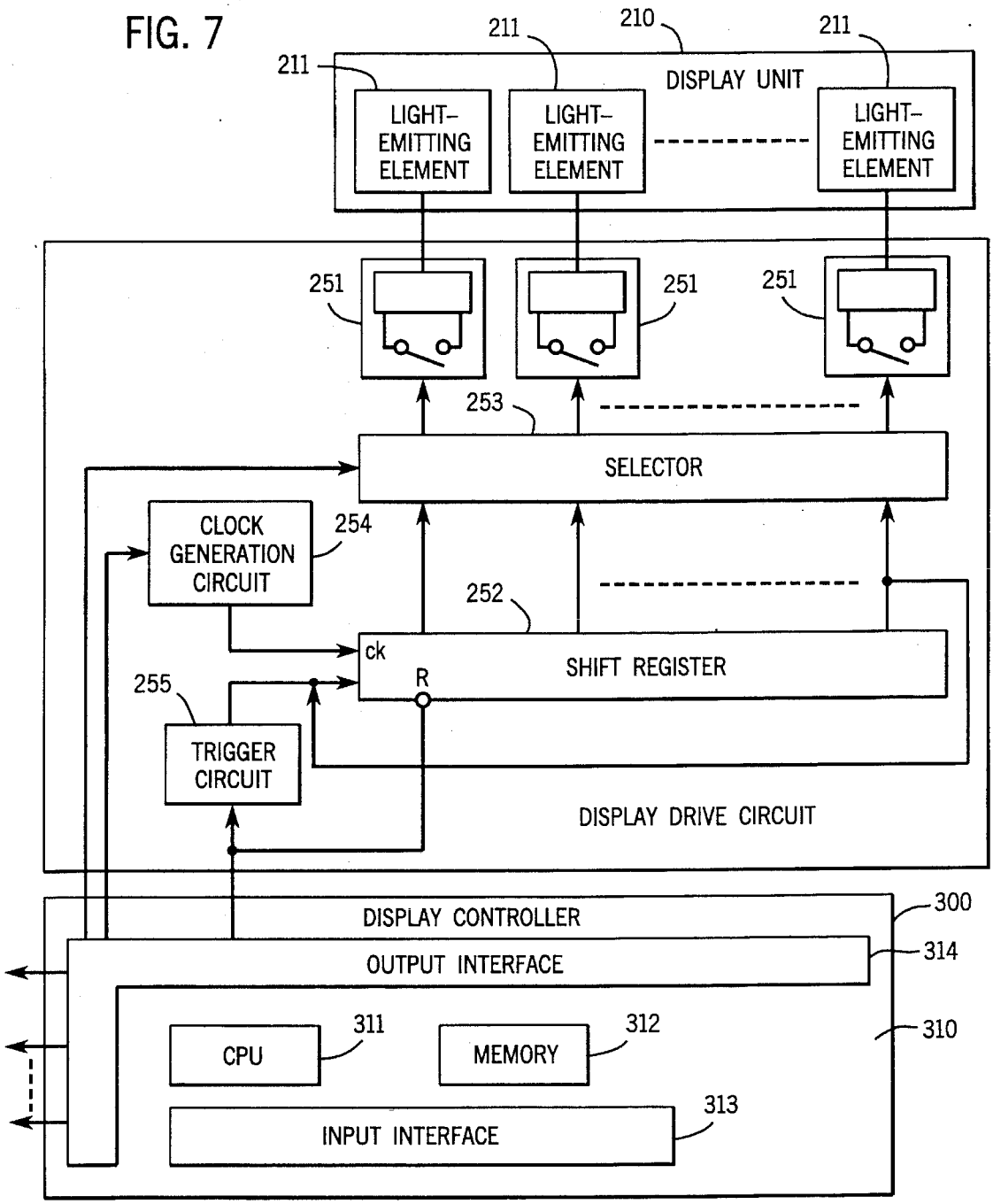
FIG. 7 is a block diagram showing the internal structure of the display controller in FIG. 6.

The display drive circuit 250 comprises drive circuits 251 each provided for each light emitting element 211 for turning on and blinking their corresponding light emitting elements, a shift register 252 for turning on the drive circuits 251 in cyclic sequence, a selector 253 for selecting the forward or reverse order for the cycle order of turning on the drive circuits 251, a clock circuit 254 for supplying clock pulses to the shift register, and a trigger circuit 255 such as a one-shot multivibrator for supplying trigger pulses to the shift register 252, for example, as shown in FIG. 7.

The shift register 252 consists of a serial in-parallel out shift register. Each time a pulse is input from the trigger circuit 255, the shift register 252 shifts the pulse in order, thereby moving the on state of each parallel-out pin in order. An output at the last stage of the shift register 252 is connected to a serial input for causing the shift operation to cycle. Therefore, once a trigger pulse is input, the shift operation is repeated until reset. Thus, the drive circuits 251 are also turned on cyclically and blinks of the light emitting elements 211 move in the forward or reverse order in response to the on cycle.

For the on cycle order of the drive circuits 251, for example, the order from left to right as viewed when facing the game machine island 10 is assumed to be the forward order and from right to left is the reverse order.

The clock circuit 254 comprises a variable frequency divider and outputs a clock pulse having a period responsive to an instruction from the display controller 300. For example, to inform personnel in the game house of the occurrence of an emergency, a change can be made so as to accelerate the movement of light and shade, etc.

The display controller 300 has the main functions of event occurrence information read means 301 for reading event occurrence information indicating the occurrence of an event for any game machine in the game machine row, distribution means 302 for distributing the game machines 1 and the display units 210 into those positioned to the left, when facing the game machine row, and those positioned to the right, with the position of the game machine 1 indicated by the event occurrence information as reference, and control means 303 for instructing the game machines 1 and the display units 210 positioned to the left to display in a display mode representing directionality from the left end to the reference position and the game machines 1 and the display units 210 positioned to the right to display in a display mode representing directionality from the right end to the reference position.

The event occurrence information read means 301 further includes a function of reading information indicating the contents of a specific condition occurring at any game machine 1.

The events read by the event occurrence information read means 301 include the following events: Some problem occurs at a game machine 1 and the player turns on a call switch (not shown); a game machine problem is detected by a sensor; an illegal act carried out by a player, such as bringing a magnet close to a game machine, is detected by a sensor; a player satisfies a given condition and game play media are paid out from the game machine for the winning game play.

The display controller 300 can consist of a computer system 310, for example, as shown in FIG. 7. That is, it has a central processing unit (CPU) 311 which performs processing such as determination about signals and control of the display drive circuits 250 for providing the above-mentioned means, a memory 312 which stores operation programs of the CPU 311 and data of determination conditions, etc., an input interface 313, and an output interface 314. The display controller 300 is not necessarily provided as an independent unit and may be provided as an internal function of a controller which controls the entire game machine island 10 or a controller contained in each game machine 1.

The memory 312 stores information for specifying a predetermined display mode. That is, it stores data indicating display modes predetermined in response to the event contents. For example, data such as the frequency of a blinking cycle of the light emitting elements and a combination of colors, etc., is stored.

In the embodiment, the game machine island 10 comprises two game machine rows disposed back to back. A plurality of such game machine islands 10 are located in a general game house.

Figure 3:
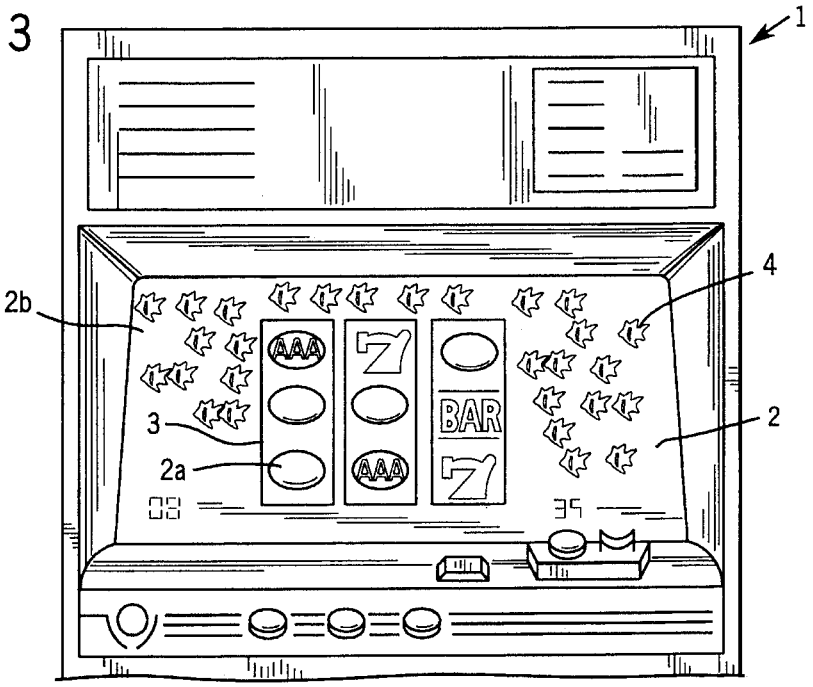
FIG. 3 is a front view showing a game machine to which the display system according to the embodiment of the invention is applied.

Slot machines, for example, are located as the game machines 1. For example, as shown in FIG. 3, the game machine 1 comprises a display 2 on the front and the display 2 comprises a game play display area **2*a* and a peripheral area 2*b* for displaying a background image outside of the display area 2*a*. Game play symbol patterns 3 corresponding to rotating drums of a slot machine are displayed in the game play display area 2*a*. On the other hand, an image not resembling the game play display contents, such as fish, is displayed in the peripheral area 2*b*** as a still picture or a dynamic image.

For example, color liquid crystal displays, color CRT displays, etc., can be used as the displays 2. In the embodiment, color liquid crystal displays are used.

Figure 8:
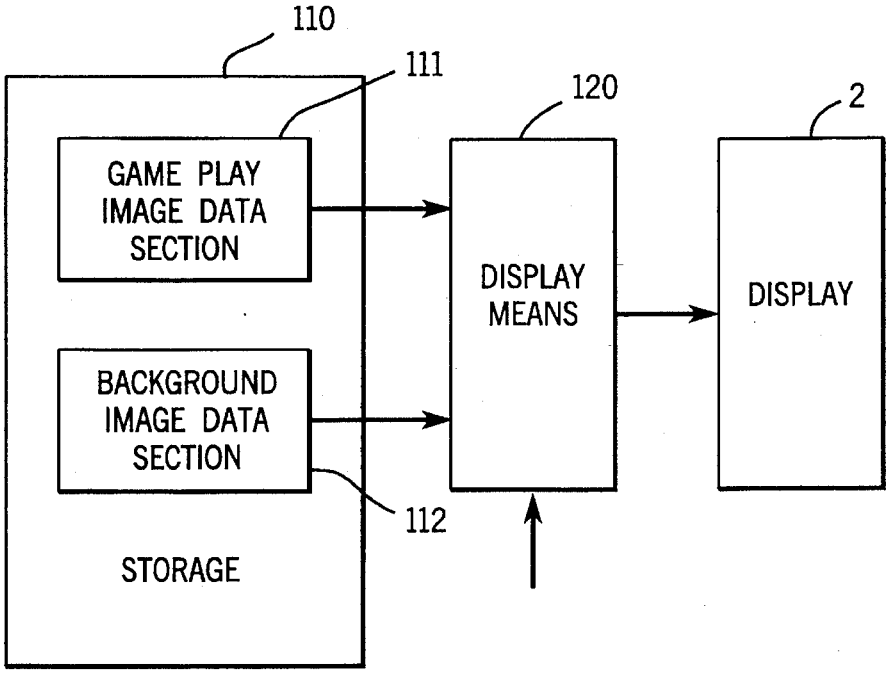
FIG. 8 is a block diagram showing the configuration of a controller of a display provided in each game machine.

For example, as shown in FIG. 8, the game machine 1 has a storage 110 which stores image data for display in the game play display area in the display 2 and background image data for display in the peripheral area outside the game play display area and display means 120 for reading image data from the storage and displaying the image on the display.

The storage 110 has a game play image data section 111 and a background image data section 112, which can be formed as different areas in a single memory or provided as different memories.

The display means 120 is provided to read a background image responsive to an instruction from the control means 303 from the background image data section 112 and display the background image on the display 2. The display means 120 can consist of a hardware logic circuit or a computer.

Next, the operation of the embodiment will be described.

First, assume that a player presses a personnel call switch. This information is read into the computer by the event occurrence information read means 301 of the display controller 300. That is, it is input to the CPU 311 as position information of the game machine at which an event has occurred. It can be easily provided by assigning unique numbers or the like to the game machines. Information indicating the contents of the event is also read. It can be easily provided by identifying signal lines or by specific code information. The event occurrence position information is sent to the distribution means 302. The information concerning the event contents is sent to the control means 303.

The display controller 300 distributes the game machines and display units by the distribution means 302 in response to the event occurrence position. The distribution result is sent to the control means 303.

In response to the distribution result, the control means 303 specifies the forward or reverse order, colors, cycles, etc., for each display unit for the display drive circuits 250.

The display drive circuit 250 outputs a clock pulse having the specified period from the clock circuit 254 to the shift register 252. For the selector 253, the forward or reverse order is specified for the blinking order of the light emitting elements 211 in the corresponding display unit 210. Further, a start signal is turned on for starting the trigger circuit 255. The starting is performed by synchronizing the display units with each other.

For example, if the trigger circuit 255 is specified so that it is turned on off the rising edge of an input pulse, the signal to the trigger circuit 255 from the control means 303 is set high, thereby starting the trigger circuit 255. If the shift register 252 is reset on the falling edge of the pulse, the signal is set low, thereby resetting the shift register 252.

Thus, each time one pulse output from the trigger circuit 255 is input and a clock pulse is input to the shift register 252, the pulse is shifted. As the pulse is shifted, the high (on) state appears in order at the parallel out terminal of the shift register.

In response to the distribution result, the selector sends the parallel output of the shift register 253 to the drive circuits 251 intact if the forward order is specified, or sends the parallel output to the drive circuits 251 in the opposite order if the reverse order is specified. This enables the light emitting elements 211 to be selectively blinked from left to fight or from right to left, in order.

That is, if the display units 210 are distributed by the distribution means 302 shown in FIG. 6 into those blinked in the forward order and those blinked in the reverse order, their light emitting elements 210 are accordingly blinked in the specified direction in order. Therefore, as shown in FIG. 4, it looks as if strips of light move in order to the target game machine.

The display unit 210 corresponding to a game machine where a problem occurs may display in such a manner that it does not blink its light emitting elements or blinks them without moving.

In the embodiment, control signals from the display controller 300 are also sent to the game machines 1. At each of the game machines 1, the signals from the display controller 300 are input to the display means 120. That is, information concerning the display mode determined corresponding to the distribution information and event contents is input to the display means 120. When receiving the information, the display means 120 reads display data of the specified pattern from the background image data section 112 and displays it in the peripheral area **2*b* of the display 2**. As the pattern, a pattern having directionality, such as graphics representing animals like fish, is used. In the embodiment, the three types of patterns are provided: Rightward, leftward, and random.

Patterns such as graphics displayed and moved on the display 2 are not limited to pictures of fish swimming in the sea as shown above and may be pictures of cheetahs running across the savannah or birds flying in the sky.

Resultantly, in the embodiment, movement of stripes of light toward the target position is repeated to move the light band toward the game machine 1 where an event has occurred in the display area 22 on the top of the game machine island 10. In FIG. 4, a personnel call source occurs at each of the game machines 1 indicated by reference numerals **1*a* and 1*b*, and light bands move in the arrow directions. At the same time, in each peripheral area 2*b* of the game machines 1** other than those at which the event occurred, a rightward pattern is displayed to the left of the game machine at which the event occurred, while a leftward pattern is displayed to the right of the game machine at which the event occurred. For example, rightward fish and leftward fish are displayed.

At this time, the object pattern display may be changed to a specific color. For the game machine at which the event occurred, the light and shade of the entire peripheral area or the graphics pattern may be changed periodically with the display pattern direction remaining random. A message may also be displayed as required.

In the embodiment, both moving display of strips of light in the display area 22 and display of a directional pattern on the display of each game machine are performed.

However, this invention is not limited to this display mode. For example, only one of them may be performed.

An indicator lamp 23 is located on both end sections of each game machine island. The indicator lamp 23 can also be blinked or turned on in a specific color according to occurrence of an event, whereby personnel in the game house who are away from the game machine islands 10 can easily observe that an event has occurred at any island.

Thus, according to the embodiment, if a personnel call source occurs at any game machine 1, an obvious display to personnel as to which game machine the personnel call source has occurred at or as to what type of personnel call is made can be made over a wide range.

The event occurrence information read means 301 has at least either of a function of reading information indicating occurrence of an event at any game machine and a function of reading information indicating that any game machine is placed in a winning condition.

Next, another embodiment of the invention will be described.

Figure 10:
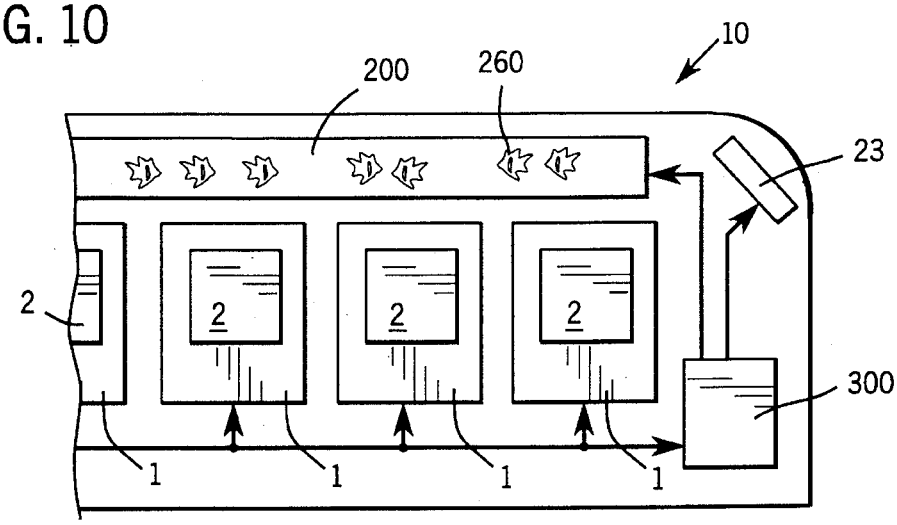
FIG. 10 is an illustration showing the configuration of another embodiment of the invention.

For example, in the embodiment shown in FIG. 10, a display unit 210 has a light emitting element 211 and a graphics pattern display section 260 for displaying a graphics pattern lit by the light emitting element.

The graphics pattern display section 260 is provided with graphics patterns having two types of directions and either one is lit by the light emitting element, thereby producing directionality. For the game machine 1 at which an event occurs, a graphics pattern may be lit without directionality. That is, the graphics pattern display section 260 has a graphics pattern showing directionality from left to right and a graphics pattern showing directionality from right to left and selectively lights either of them by the light emitting element in response to an instruction from the display controller 300.

Figure 11:
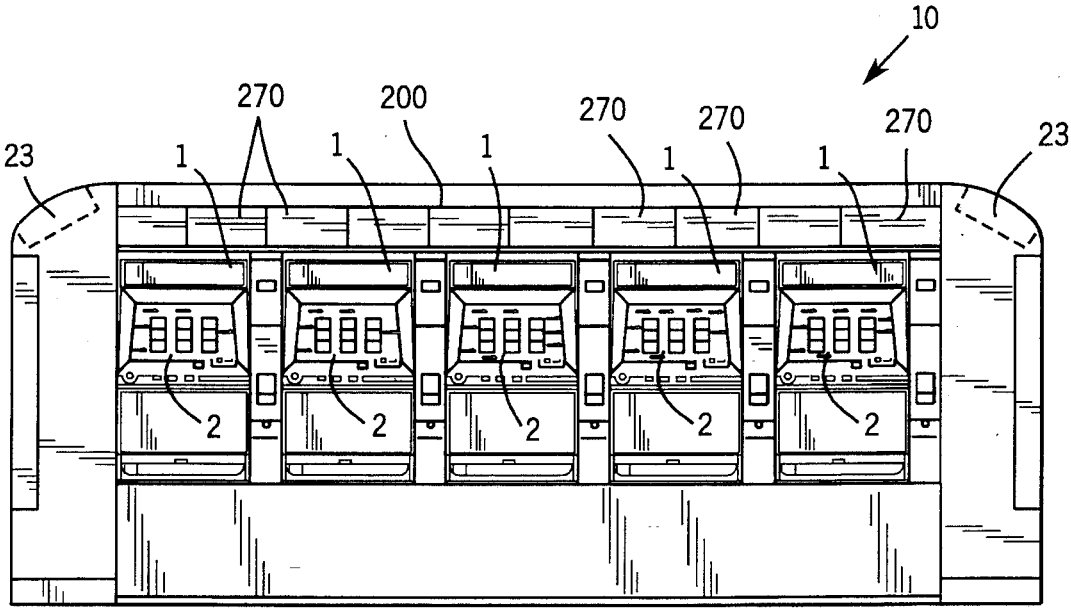
FIG. 11 is an illustration showing the configuration of another embodiment of the invention.

As another embodiment of the invention, an example in which each display 270 unit is made of a panel display is given as shown in FIG. 11. In the example, a drive circuit (not shown) having a similar configuration to that shown in FIG. 8 is used. That is, it can be provided with a memory which stores image data for generating graphics displayed on the screen of the panel display and display means. The display controller of the game machine 1 corresponding thereto can also be used.

Figure 9:
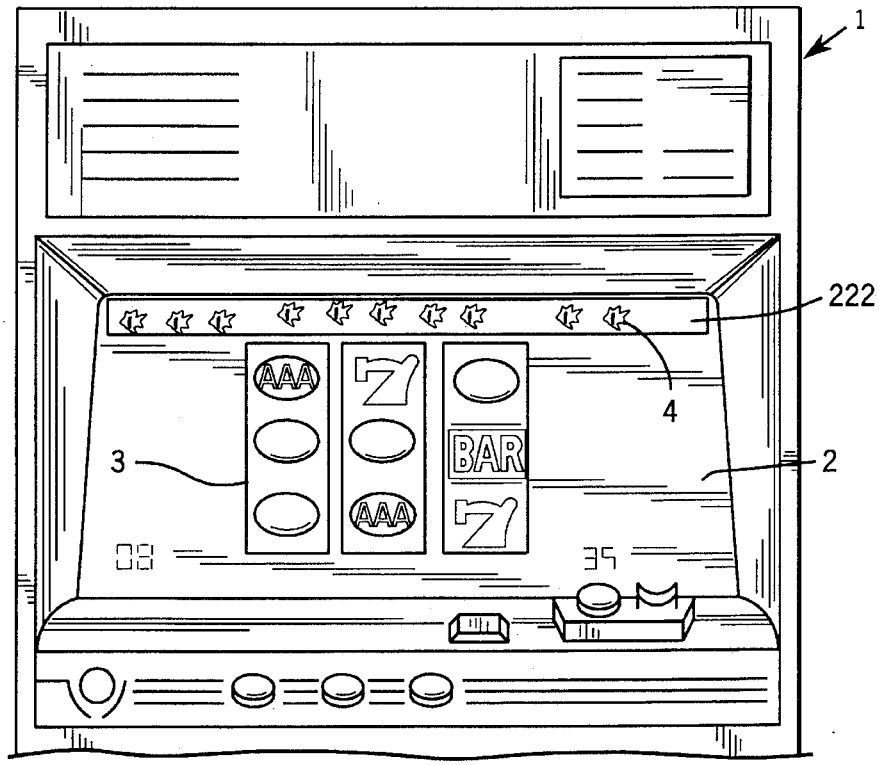
FIG. 9 is an illustration showing the configuration of another embodiment of the invention.

A still further embodiment of the invention is as shown in FIG. 9. A system according to the embodiment has a display device 222 in each game machine 1 and a display controller (not shown) for controlling the operation of the display device 222.

The display controller comprises event occurrence information read means 301, when a signal indicating that any game machine in the corresponding game machine row is placed in a predetermined specific condition is input, for reading information indicating the position of the game machine, distribution means 302 for distributing the display devices 222 into those positioned to the left, when facing the game machine row, and those positioned to the right, with the position corresponding to the position indicated by the information as reference, and control means for controlling so as to cause the display devices 222 positioned to the left to display in a display mode representing directionality from the left end to the reference position and to cause the display devices 222 positioned to the right to display in a display mode representing directionality from the right end to the reference position, as shown in FIG. 6.

In the description of the above-mentioned embodiments, the display system functions only when a personnel call source has occurred, but the invention is not limited to this mode. For example, it may also serve as fever display when a game machine is placed in a winning condition. That is, when a player wins a game play, a winning signal is output from the game machine. When receiving the winning signal, the display control means causes graphics patterns or the like described above to move on display in a fever display color, for example, in blue.

In the above-mentioned embodiments, each of the display units 210 is provided with a plurality of light emitting elements 211, but the invention is not thus limited to it. For example, one display unit 210 may be provided with one light emitting element 211. In this case, the display drive circuit 250 is not provided for each display unit 210 and one display drive circuit is assigned to a plurality of display units.

According to the display system at the game machine island according to the invention, if a personnel call source such as a problem occurs at any game machine, personnel in the game house can be informed immediately and precisely of the game machine where the source such as the problem has occurred. Events such as a winning game play can also be displayed in a similar manner.

Moreover, if the color of displayed graphics patterns or the like is varied depending on the type of call source, personnel in the game house can know quickly and precisely what type the call source is, and can promptly take proper action to deal with the problem, etc.

We claim:

1. A system for displaying occurrence of an event at a game machine island having at least one game machine row comprising a plurality of game machines placed side by side, said display system comprising:

a dome display having a display area provided along the game machine row of the game machine island for displaying in the display area; and a display controller for controlling operation of said dome display, said dome display comprising a plurality of display units for displaying in a specified mode and drive circuits for driving the display units, said plurality of display units being disposed in said display area, said display controller comprising:

event occurrence information read means for, when a signal indicating that any game machine in the game machine row is in a predetermined specific condition is input, reading information indicating a position of the game machine;

means for distributing said plurality of display units into those positioned to the left, when facing the game machine row, and those positioned to the right, with a position corresponding to the position indicated by the information as reference; and means for controlling so as to cause said display units positioned to the left to display in a display mode representing directionality from the left end to the reference position and to cause said display units positioned to the fight to display in a display mode representing directionality from the right end to the reference position.

2. The display system as claimed in claim 1 wherein each of said display units has at least one light emitting element, and said controlling means changes light and shade of said light emitting elements of said display units in an arrangement order of said display units for displaying in the display mode representing the directionality.

3. The display system as claimed in claim 1 wherein each of said display units has a plurality of light emitting elements arranged along the game machine row, and said controlling means changes light and shade of said light emitting elements in their arrangement order in each display unit for displaying in the display mode representing the directionality.

4. The display system as claimed in claim 1 wherein said event occurrence information read means is further defined as reading information indicating contents of a specific condition occurring at any game machine, said display controller means further comprises means for storing information for specifying a predetermined display mode in response to the information indicating the specific condition contents, and said controlling means reads the stored information for specifying a display mode in response to the read information indicating the specific condition contents for causing the display means to display in the display mode.

5. The display system as claimed in claim 4 wherein said event occurrence information read means is further defined as at least either reading information indicating occurrence of an event at any game machine and reading information indicating that any game machine is placed in a winning condition.

6. The display system as claimed in claim 1 wherein each of said display units has a light emitting element and a graphics pattern display section for displaying a graphics pattern lit by the light emitting element.

7. The display system as claimed in claim 6 wherein said graphics pattern display section has a graphics pattern showing directionality from left to right and a graphics pattern showing directionality from right to left and selectively lights either of them by the light emitting element in response to an instruction from said display controller means.

8. The display system as claimed in claim 1 wherein each of said display units has a panel display and each of said drive circuits has a memory which stores image data for generating graphics displayed on a screen of said panel display.

9. The display system as claimed in claim 8 wherein each of said drive circuits his means for moving image data in a direction conforming to the directionality on the screen of said panel display.

10. The display system as claimed in claim 8 wherein said memory stores image data representing graphics patterns corresponding to said two types of directionality.

11. A system for displaying occurrence of an event at a game machine island having at least one game machine row comprising a plurality of game machines placed side by side, said display system comprising:

a display having a display area in each game machine for displaying in the display area; and a display controller for controlling operation of said display, said display comprising a plurality of display units for displaying in a specified mode and drive circuits for driving the display units, said plurality of display units being disposed in said display area, said display controller comprising:

event occurrence information read means for, when a signal indicating that any game machine in the game machine row is in a predetermined specific condition is input, reading information indicating a position of the game machine;

means for distributing said plurality of display units into those positioned to the left, when facing the game machine row, and those positioned to the right, with a position corresponding to the position indicated by the information as reference; and means for controlling so as to cause said display units positioned to the left to display in a display mode representing directionality from the left end to the reference position and to cause said display units positioned to the right to display in a display mode representing directionality from the right end to the reference position.

12. A system for displaying occurrence of an event at a game machine island having at least one game machine row comprising a plurality of game machines placed side by side, each game machine comprising a display within which an area for playing games is displayed, said display system comprising:

a display controller for, upon occurrence of some event for any game machine in the game machine row, for controlling so as to change a display mode of the displays of the game machines belonging to the game machine row accordingly, said display controller comprising:

event occurrence information read means for reading event occurrence information indicating occurrence of an event for any game machine in the game machine row;

means for distributing said plurality of game machines into those positioned to the left, when facing the game machine row, and those positioned to the right, with a position of the game machine indicated by the event occurrence information as reference; and control means for instructing the displays of the game machines positioned to the left to display in a display mode representing directionality from the left end to the reference position and instructing the displays of the game machines positioned to the right to display in a display mode representing directionality from the right end to the reference position, each of said game machines having a storage for storing image data for display in the game play display area in the display and background image data for display in a peripheral area outside the game play display area and display means for reading image data from said storage and displaying on the display, said display means displaying a background image on the display in response to an instruction from said control means.

13. A system for displaying occurrence of an event at a game machine island having at least one game machine row comprising a plurality of game machines placed side by side, each game machine comprising a display within which an area for playing games is displayed, said display system comprising:

a dome display having a display area provided along the game machine row of the game machine island for displaying in the display area; and a display controller for, upon occurrence of some event for any game machine in the game machine row, controlling so as to change display modes of the displays of the game machines and said dome display belonging to the game machine row accordingly, said dome display comprising a plurality of display units for displaying in a specified mode and drive circuits for driving the display units, said plurality of display units being disposed in said display area, said display controller comprising:

event occurrence information read means for reading event occurrence information indicating occurrence of an event for any game machine in the game machine row;

means for distributing said plurality of game machines and display units into those positioned to the left, when facing the game machine row, and those positioned to the fight, with a position of the game machine indicated by the event occurrence information as, reference; and control means for instructing said game machines and said display units positioned to the left to display in a display mode representing directionality from the left end to the reference position and instructing those positioned to the right to display in a display mode representing directionality from the right end to the reference position, each of said game machines having a storage for storing image data for display in the game play display area in the display and background image data for display in a peripheral area outside the game play display area and display means for reading image data from said storage and displaying on the display, said display means displaying a background image on the display in response to an instruction from said control means.

* * * * *